US008534109B1

(12) United States Patent
Golovashchenko

(10) Patent No.: US 8,534,109 B1
(45) Date of Patent: Sep. 17, 2013

(54) CALIBRATING HYDRO-FORMED TUBULAR PARTS

(71) Applicant: Ford Global Technologies, LLC, Dearborn, MI (US)

(72) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 13/646,870

(22) Filed: Oct. 8, 2012

(51) Int. Cl.
*B21D 37/16* (2006.01)
*B21D 22/10* (2006.01)

(52) U.S. Cl.
USPC ..... 72/342.96; 72/61; 72/370.23; 72/370.27; 72/342.94; 72/364

(58) Field of Classification Search
USPC ..... 72/200, 342.94, 342.96, 364, 379.2
See application file for complete search history.

(56) References Cited

U.S. PATENT DOCUMENTS 6,463,779 B1 * 10/2002 Terziakin ..... 72/342.96
6,875,964 B2 4/2005 Golovashchenko et al.
7,302,821 B1 12/2007 Dariavach et al.
7,516,640 B2 * 4/2009 Golovashchenko et al. ..... 72/342.96
8,021,501 B2 * 9/2011 Roth ..... 148/566
2005/0044913 A1 * 3/2005 Ni et al. ..... 72/61
2010/0024503 A1 * 2/2010 Bradley et al. ..... 72/61

FOREIGN PATENT DOCUMENTS

CN 101353723 1/2009
CN 101713021 5/2010

OTHER PUBLICATIONS

Sergey F. Golovashchenko, Springback Calibration Using Pulsed Electromagnetic Field, CP778 vol. A, Numisheet 2005, pp. 284-285.
Sergey F. Golovashchenko, Calibration of shape distortion of stamped or heat treated parts by propagating pulses of DC current, IP.com No. IPC0M000167243D, Feb. 4, 2008.

* cited by examiner

*Primary Examiner* — David B Jones
(74) *Attorney, Agent, or Firm* — Raymond L. Coppiellie; Brooks Kushman P.C.

(57) ABSTRACT

A method and apparatus are disclosed for making a hydro-formed part by first hydro-forming a tubular blank to form an initially formed part. The initially formed part is clamped in a calibration tool with clamps. The initially formed part is connected to a source of electric current and electric current is pulsed through the initially formed part to reduce internal stresses in the initially formed part and reduce spring-back to form the initially formed part to a target shape.

10 Claims, 1 Drawing Sheet

CALIBRATING HYDRO-FORMED TUBULAR PARTS

TECHNICAL FIELD

This disclosure relates to pulsing direct current through a hydro-formed part while the part is clamped in a tool that holds the part in a targeted shape.

BACKGROUND

The idea of pulsating DC electric current through a sheet metal blank that is clamped to a surface in targeted shape to eliminate spring-back was derived from observations of tensile tests conducted in conjunction with superimposed pulses of DC current. The idea of improving formability of sheet metal parts made of aluminum alloys by pulsating DC current resulted from this testing. This concept was disclosed in S. Golovashchenko, A. Krause, J. Roth "Method and apparatus for forming a blank as a portion of the blank receives pulses of direct current" U.S. Pat. No. 7,516,640. It was observed while analyzing the stress-strain tensile test curve that the stress is reduced when the current is propagated through the blank.

Applicant is the author of a defensive publication entitled "Calibration of shape distortion of stamped or heat treated parts by propagating pulses of DC current" Defensive publication IPCOM 000167243D. The defensive publication discloses that after a stamped blank is released from a stamping die, it often changes shape as a result of spring-back. The shape of the sheet blank can be corrected by propagating a DC current through it.

Weight reduction requirements for vehicles are leading to broader adoption of parts made from advanced high strength steels and aluminum alloys. Spring-back for these materials is more difficult to compensate for than spring-back in mild steels. To develop a die for aluminum sheet metal or high strength steels that compensates for spring-back may require, in some cases, ten or more die face recuts.

Recently, a number of numerical algorithms of spring-back compensation were developed to calculate the die face geometry. Another approach to resolve the spring-back issue is to stretch the blank at the end of the stamping cycle to reduce the bending moments inside the blank. However, this approach limits the depth of the drawing process, which is already restricted by insufficient formability of advanced high strength steels and aluminum alloys. The use of algorithms and stretching the blank post-forming are not satisfactory if the material properties vary from coil to coil, or if the die geometry varies during its life time due to the die wear.

Hydro-formed members cannot be stretched like sheet metal parts to eliminate spring-back. The primary approach to eliminating spring-back in hydro-formed tubular members is to over bend the tube to compensate for spring-back. However, this approach is subject to manufacturing variability due to variations in material content, material thickness, and other factors.

The idea of calibrating blanks stamped from sheet metal by clamping them to the targeted shape and propagating pulsed current induced through high voltage discharge of capacitors through the insulated metallic coil clamped to the sheet metal blank was presented in U.S. Pat. No. 7,540,180; S. Golovashchenko, V. Dmitriev, P. Canfield, A. Krause, C. Maranville "Apparatus for electromagnetic forming with durability and efficiency enhancements." This concept was also explained in S. Golovashchenko: "Springback calibration using pulsed electromagnetic field," Proceedings of the 6$^{th}$ International Conference NUMISHEET 2005, Detroit, p. 284-285.

All the efforts described above target calibration of blanks stamped from sheet metal. Problems relating to calibrating and relieving stress in hydro-formed aluminum or high strength steel tubular parts were not disclosed or addressed in the above publications and patents.

SUMMARY

One aspect of the proposed solution is to calibrate the part shape by clamping the hydro-formed tubular part blank to its targeted shape and then applying pulses of electric current to relieve internal stresses inside the blank. This procedure can be conducted using DC pulses that are applied to the sample during tensile testing. The blank is positioned inside a calibration die that includes an upper die and a lower die. The calibration die may be fabricated from a material with low electrical conductivity or the die may have inserts of material with low electric conductivity that are assembled inside the die facing the blank surface. The blank may be connected to the source of electric current through local inserts fabricated from material of good electric conductivity. The blank is clamped to its targeted shape when the die is closed and calibrating local electric pulses are applied through the conductive inserts. These pulses are applied locally in the areas of internal stress concentration inside the blank. The clamping force prevents die opening during the calibration process.

According to one aspect of this disclosure, a method is disclosed for making a hydro-formed part by first hydro-forming a tubular blank to form an initially formed part. The initially formed part is clamped in a calibration tool. The initially formed part is connected to a source of electric current and electric current is pulsed through the initially formed part to reduce internal stresses in the initially formed part and reduce spring-back to form the initially formed part to a target shape.

According to other aspects of this disclosure, the step of connecting the initially formed part to a source of electrical current may further comprise connecting a first end of the initially formed part to a first electrical connector and connecting a second end of the initially formed part to a second electrical connector. The step of clamping the initially formed part in a calibration tool may further comprise clamping a first portion of the initially formed part that is a straight portion of the initially formed part that is adjacent a second portion of the initially formed part that was subjected to bending stresses during the hydro-forming step. The first portion and the second portion of the initially formed part may be disposed between the first electrical connector and the second electrical connector. The step of clamping the initially formed part in a calibration tool may further comprise clamping a second portion of the initially formed part that is a straight portion of the initially formed part that is adjacent the first portion of the initially formed part that was subjected to bending stresses during the hydro-forming step.

According to another embodiment of this disclosure, the step of connecting the initially formed part to a source of electrical current may further comprise assembling a split coil around a first portion of the initially formed part that was subjected to bending stresses during the hydro-forming step. The split coil may be connected to a source of direct current.

According to another aspect of this disclosure, a calibration fixture is disclosed for a tubular hydro-formed part. A receptacle defines a cavity for receiving the part and at least one electrode is electrically connected to the part. A clamp clamps the part in the receptacle to hold the part in a target shape. Electrical current is provided to the part through the electrode to relieve stress in the part and reduce spring-back.

According to other aspects of the disclosed calibration fixture, a second electrode may be electrically connected to the part to create a flow of electric current through the part from the electrode to the second electrode. The calibration fixture may further comprise a plurality of clamps that engage the part between the electrode and the second electrode. The electrode may contact the part at a first tubular end and the second electrode may contact the part at a second tubular end. The clamps may engage straight portions of the part in the receptacle.

According to other aspects of this disclosure as it relates to the calibration fixture, the electrode may be a split electrode that is separated to receive the part and is joined together around a selected portion of the part. The electrode may be joined together at a location on the part that has high residual stresses from forming operations that occurred before the part is received in the receptacle.

The above aspects and other aspects of this disclosure will be more fully described below in the detailed description of the illustrated embodiments in view of the attached drawings.

DETAILED DESCRIPTION

The illustrated embodiments are disclosed with reference to the drawings. However, it is to be understood that the disclosed embodiments are intended to be merely examples that may be embodied in various and alternative forms. The figures are not necessarily to scale and some features may be exaggerated or minimized to show details of particular components. The specific structural and functional details disclosed are not to be interpreted as limiting, but as a representative basis for teaching one skilled in the art how to practice the disclosed concepts.

Figure 1:
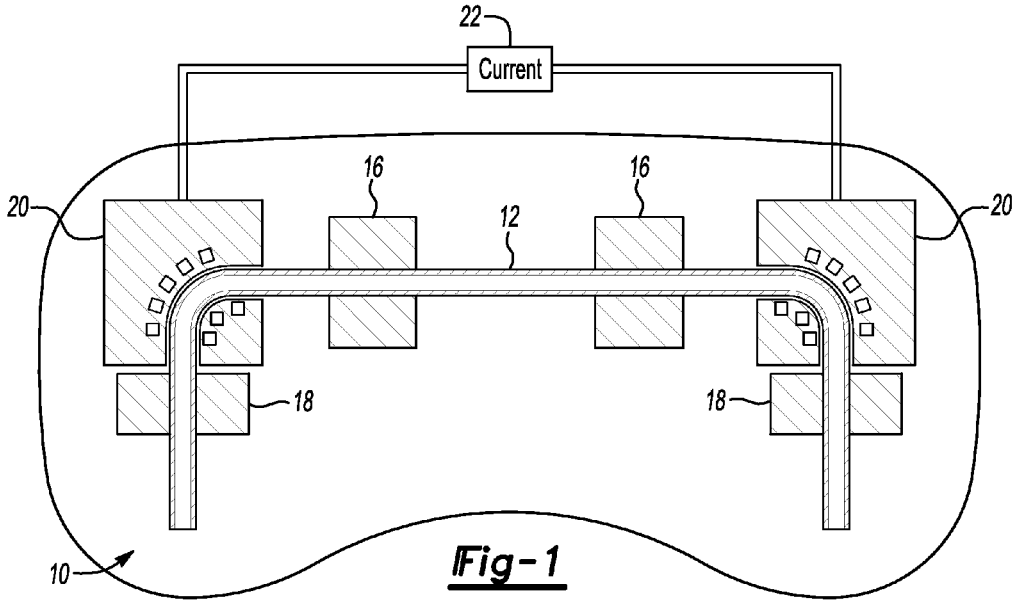
FIG. 1 is a diagrammatic cross-sectional view of a calibration tool that has split coils and clamps engaging a tubular hydro-formed part.

Referring to FIG. 1, a calibration fixture 10, or calibration tool, is illustrated that receives a hydro-formed tubular part 12. The tubular part 12 is held in position by two intermediate clamps 16 and two end clamps 18. A pair of split coils 20 are provided on the fixture 10 and the tubular part 12 is inserted into the split coils 20. The disclosure of the description of the split coils in U.S. Pat. No. 6,875,964 is incorporated by reference.

AC electrical current is provided by a source of electrical current 22, such as an AC generator or a capacitor based pulse generator, to the split coils 20 while the part is clamped in a target shape, or design shape, to form a finished hydro-formed part 12'. The calibration fixture 10 may be made from steel that is insulated from ground or may be made from insulating inserts, such as ceramic inserts.

Figure 2:
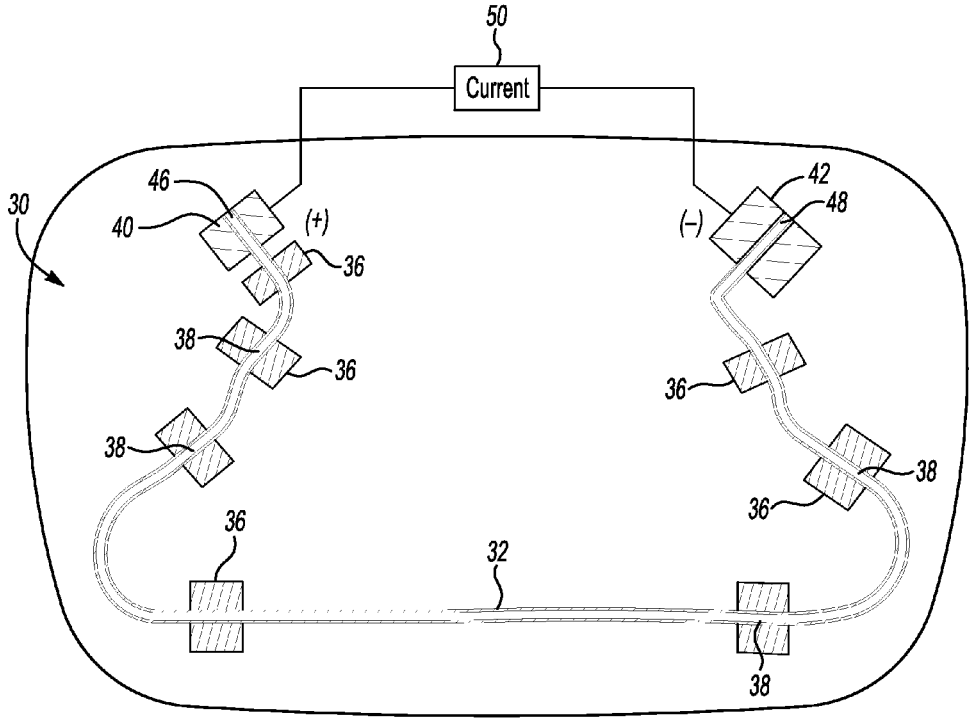
FIG. 2 is a diagrammatic cross-sectional view of a calibration tool that has two electrodes that engage opposite ends of a tubular hydro-formed part and clamps that engage the hydro-formed part.

Referring to FIG. 2, an alternative embodiment of a calibration fixture 30, or calibration tool, is illustrated that receives a hydro-formed part 32. The tubular part 32 is held in position by a plurality of clamps 36. The clamps 36 are generally located in areas of low residual stress in the hydro-formed part that generally corresponds to the straight sections 38 of the hydro-formed part 32. A positive electrode 40 and a negative electrode 42 are connected to a first tubular end 46 and a second tubular end 48 of the hydro-formed part 32.

Pulses of DC electrical current are provided by a source of electrical current 50, such as a battery or a voltage convertor, to the first electrode 40 and second electrode 42 while the part is clamped by the clamps 36 in a target shape, or design shape, to form a finished hydro-formed part 32'. A DC welder can be employed as a source of DC current. The clamps 36 may be made from insulating material, such as ceramic material.

While exemplary embodiments are described above, it is not intended that these embodiments describe all possible forms of the disclosed apparatus and method. Rather, the words used in the specification are words of description rather than limitation, and it is understood that various changes may be made without departing from the spirit and scope of the disclosure as claimed. The features of various implementing embodiments may be combined to form further embodiments of the disclosed concepts.

What is claimed is:

1. A method of making a hydro-formed part comprising:

hydro-forming a tubular blank to form an initially formed part;

clamping the initially formed part in a calibration tool by clamping a first portion of the initially formed part that is a straight portion of the initially formed part that is adjacent to a second portion of the initially formed part that was subjected to bending stresses during the hydro-forming step;

connecting a first end of the initially formed part to a first electrical connector and connecting a second end of the initially formed part to a second electrical connector; and pulsing the electric current through the initially formed part to reduce internal stresses in the initially formed part and reduce spring-back to form the initially formed part to a target shape.

2. The method of claim 1 wherein the first portion and the second portion of the initially formed part are disposed between the first electrical connector and the second electrical connector.

3. The method of claim 1 wherein the step of connecting the initially formed part to a source of electrical current further comprises assembling a split coil around a first portion of the initially formed part that was subjected to bending stresses during the hydro-forming step.

4. The method of claim 3 wherein the step of clamping the initially formed part in a calibration tool further comprises clamping a second portion of the initially formed part that is a straight portion of the initially formed part that is adjacent the first portion of the initially formed part that was subjected to bending stresses during the hydro-forming step.

5. The method of claim 3 wherein the split coil is connected to a source of alternating current.

6. A calibration fixture for a tubular hydro-formed part comprising:

a receptacle electrically insulated from ground defining a cavity for receiving the part;

a first electrode electrically connected to the part;

a second electrode electrically connected to the part, wherein the electrode and the second electrode create a flow of electric current through the part;

a plurality of clamps for clamping the part in the receptacle between the first electrode and the second electrode to hold the part in a target shape, wherein the plurality of clamps contact a plurality of straight portions of the part in the receptacle; and wherein electrical current is provided to the part through the electrode to relieve internal stress in the part and reduce spring-back.

7. The calibration fixture of claim 6 wherein the electrode contacts the part at a first tubular end and the second electrode contacts the part at a second tubular end, and wherein the electrical current is pulsed direct current.

8. The calibration fixture of claim 6 wherein the electrode is a split electrode that is separated to receive the part and is joined together around a selected portion of the part that has high residual stresses from forming operations that occurred before the part is received in the receptacle.

9. The calibration fixture of claim 8 wherein the electrical current is direct current.

10. The calibration fixture of claim 6 wherein the receptacle and the clamp are both formed from non-electrically conductive material.

* * * * *